US005890763A

United States Patent [19]

Asbjørnsen

[11] Patent Number: 5,890,763

[45] Date of Patent: Apr. 6, 1999

[54] ARRANGEMENT IN A PIVOTABLE MOUNTING, ESPECIALLY FOR A CHAIR

[75] Inventor: Svein Asbjørnsen, Sykkylven, Norway

[73] Assignee: Svein Asbjørnsen Produktdesign AS, Sykkylven, Norway

[21] Appl. No.: 763,680

[22] Filed: Dec. 11, 1996

[51] Int. Cl.[6] ..... A47C 3/00

[52] U.S. Cl. ..... 297/285; 248/291.1; 403/291; 297/296

[58] Field of Search ..... 297/285, 297, 297/296; 248/291.1, 900; 403/291

[56] References Cited

U.S. PATENT DOCUMENTS

| | | | |
|---|---|---|---|
| 4,451,085 | 5/1984 | Franck et al. | 297/285 X |
| 4,580,836 | 4/1986 | Verney | 297/296 |
| 4,603,904 | 8/1986 | Tolleson et al. | 403/291 X |
| 4,611,946 | 9/1986 | Gebelius | 403/291 X |
| 4,869,552 | 9/1989 | Tolleson et al. | 297/296 |
| 5,433,549 | 7/1995 | McGaffigan | 403/291 X |
| 5,445,471 | 8/1995 | Wexler et al. | 403/291 X |
| 5,564,982 | 10/1996 | Gipson et al. | 403/291 X |

FOREIGN PATENT DOCUMENTS

| | | |
|---|---|---|
| 34 23 857 C2 | 8/1989 | Germany . |
| 2 217 984 | 11/1989 | United Kingdom . |

*Primary Examiner*—Peter M. Cuomo
*Assistant Examiner*—Stephen Vu
*Attorney, Agent, or Firm*—Darby & Darby

[57] ABSTRACT

A pivotable fastening for a chair, includes fastening members as well as a resilient element allowing resilient displacement of the fastening members The fasting has two substantially identical fastening members one of which has a, and delete the remainder of the line said fastening members (2A) comprising a first cup-shaped pivotable portion having first protruding stoppers. The second fastening member has a second corresponding cup-shaped pivotable portion having second protruding stoppers both fastening members encircle a string-shaped elastic element extending through both fastening member.

10 Claims, 3 Drawing Sheets

ARRANGEMENT IN A PIVOTABLE MOUNTING, ESPECIALLY FOR A CHAIR

FIELD OF THE INVENTION

The present invention relates to an arrangement in connection with a pivotable fastening, especially for a chair, of the type as stated in the preamble of the attached patent claim 1.

PRIOR ART

There are previously known chairs, for example conference chairs, or nestable chairs, which are provided with elastic and resilient portions both in the back support and in the seat portion. The elastic portion in the back support shall give the user the possibility of leaning backwards in order to stretch the spine, whereas the resilient portion in the seat will release the pressure underneath the thighs of the user. In connection with such chairs, without introducing any limitations to the present invention, there are developed various types of resilient means adapted to give the chair the desired resilient properties, at the same time as the overall design of the chair has to be functional and render a pleasant appearance.

According to DE 3 423 857 (Bräuning) there is in connection with a chair previously known a tensioning band which is specifically illustrated in FIGS. 4*a* and 4*b*, and which extends, not through, but outside of a bending element, for thereby in a first position as illustrated in FIG. 4*a*, to provide a pulling function of the upper portion of the backrest of the chair, whereas, when said upper back support portion is loaded, as illustrated in FIG. 4*b*, the tensioning band will be resiliently stretched, such that appropriate abutment surfaces may be brought apart from each other in order to bring the upper portion of the back support to a rearwardly tilting position.

In U.S. Pat. No. 4,580,863 (Verney) there is disclosed a bent spring material, but here the spring itself is functioning as a fastening alone, each end of said spring being attached in a separate peg, which is different from a through-going string-shaped resilient or elastic element. Neither does the chair element according to U.S. Pat. No. 4,580,863 disclose any cup-shaped pivoting portions, but only a molded polyurethane portion provided with appropriate beads and only with the object of protecting the user of the chair against contact with said resilient spring. The attachment of the prior art string in each of the pegs involves an expensive and time-consuming assembly, at the same time as the replacement of the string, for example with a material having larger or less resiliency, will involve a very complicated process.

From U.S. Pat. No. 4,869,552 (Tollesson et al.) there are known two equal fastening members, but these fastening members are not designed with cup-shaped pivotable portions, let alone with protruding stoppers in said pivotable portions, and neither is the prior art fastener arranged for encircling a string-shaped elastic element extending through both fastening members. It is true that according to the prior art there is devised a resilient means which at its opposite ends are attached in two holding means, but these holding means are assembled by being kept together by the elastic element itself, i.e. without any mutually engaging pivoting portions adapted for relative pivotable movement. In connection with the assembly according U.S. Pat. No. 4,869,552 it is rather a token about a tilting fastening, since the spacing between the two holding means, given by the mutual distance therebetween, will limit the range of the tilting in one or the other direction.

From GB 2 217 984 (Maddocks) there are known pivoting plates, as discussed in connection with FIG. 4 of said publication, and wherein One of the plates are provided with holes, whereas the opposite plate carries a spring loaded stopping means fitting into one of the holes, in dependence of the angular position of the back member in relation to other elements included in the sitting/resting chair according to said publication, i.e. without resilient pivotable properties at all.

OBJECTS OF THE INVENTION

The object underlying the present invention is to provide a pivotable fastening, especially for a chair, which in a simple and effective manner can provide a chair having resilient back support and back support portions, respectively, and/or resilient seat and seat portions, respectively.

A further object of the invention is to provide a pivotable fastening which comprises simple and inexpensive parts, both as regards selection of material and the manufacturing thereof.

Still another object of the invention is to provide a pivotable fastening which can be adapted to various pipe structures for chairs.

Yet another object of the invention is to provide a pivotable fastening which can render various degrees of resilient angular displacement, at the same time as the angular displacements can be dampened by means of appropriate expenditures.

SUMMARY OF THE INVENTION

The above objects are achieved in an arrangement of the type as stated in the preamble, which according to the present invention is characterized in that the assembly comprises:

two substantially equal fastening members, the first fastening member comprising a first cup-shaped pivotable portion having first stoppers protruding from the bottom of said cup, the second fastening member being adapted to be engaged in said first fastening member and comprising a second corresponding cup-shaped pivotable portion having second stoppers protruding from the bottom of said cup, and both fastening members being adapted, in their pivotable assembly, to allow encircling of a string-shaped elastic element extending through both fastening members.

Further features and advantages in connection with the present invention will appear from the following description taken in connection with the attached drawings, as well as from the appending patent claims.

BRIEF DISCLOSURE OF THE DRAWINGS

DESCRIPTION OF EMBODIMENTS

Figure 1:
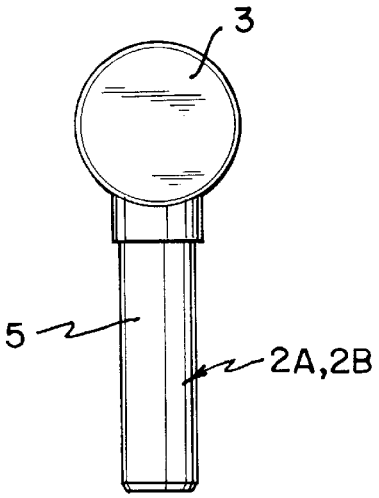
FIG. 1 is a view as seen from a first side of an embodiment of a pivotable fastening according to the present invention.
Figure 3:
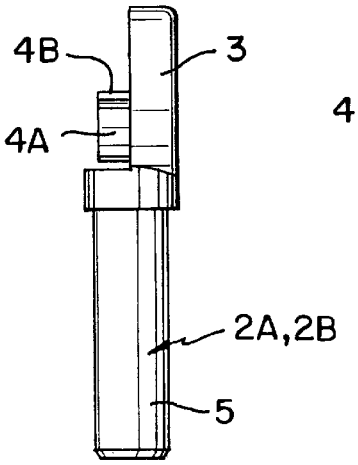
FIG. 3 is a side view of the pivotable fastening member as illustrated in FIGS. 1 and 2.
Figure 4:
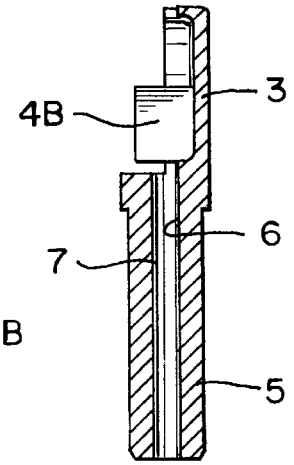
FIG. 4 is a section taken along the lines 4—4 in FIG. 2.

In FIGS. 1–6 there is illustrated an embodiment of a pivotable fastening member which can be included in an embodiment of a pivotable fastening according to the present invention. It is to be understood that the assembled pivotable fastening itself, is designated by reference numeral 1, see FIGS. 7–9, and comprises two substantially equal fastening members 2A and 2B, respectively, one of said fastening members, for example the member 2A being illustrated in FIGS. 1–6. However, it is to be understood that the second fastening member 2B can have the same embodiment as said fastening member 2A.

Figure 5:
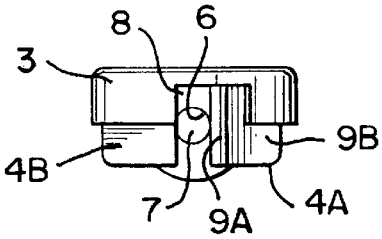
FIG. 5 is a top view of the pivotable fastening member illustrated in FIGS. 1–3.
Figure 6:
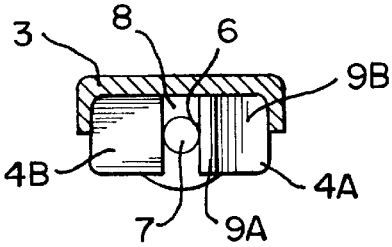
FIG. 6 is a section taken along the line. 6—6 in FIG. 2
Figure 7:
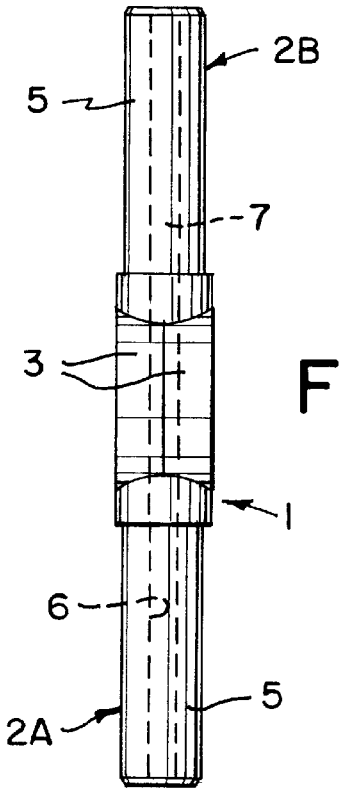
FIG. 7 is a side view, as seen from a first side, of the two pivotable fastening members according to the invention assembled to a pivotable fastening.

As most clearly appearing from FIGS. 1–6, each fastening member 2A and 2B, respectively, comprises a first cup-shaped pivotable portion 3 having first protruding stoppers 4A and 4B, which is also the case with said second corresponding fastening member 2B, see specifically FIG. 7.

Figure 8:
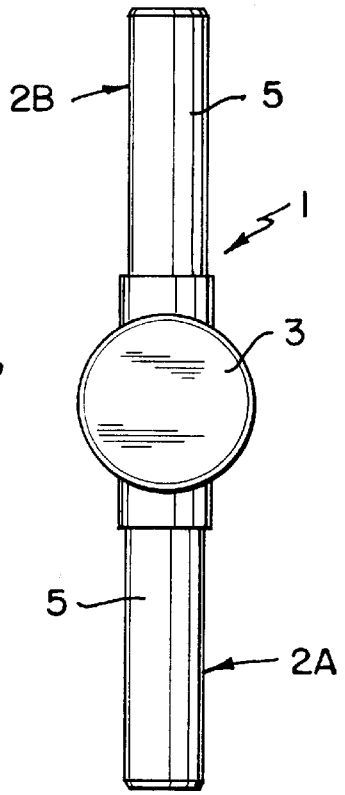
FIG. 8 is a front view of the two pivotable fastening member as illustrated in FIG. 7.
Figure 9:
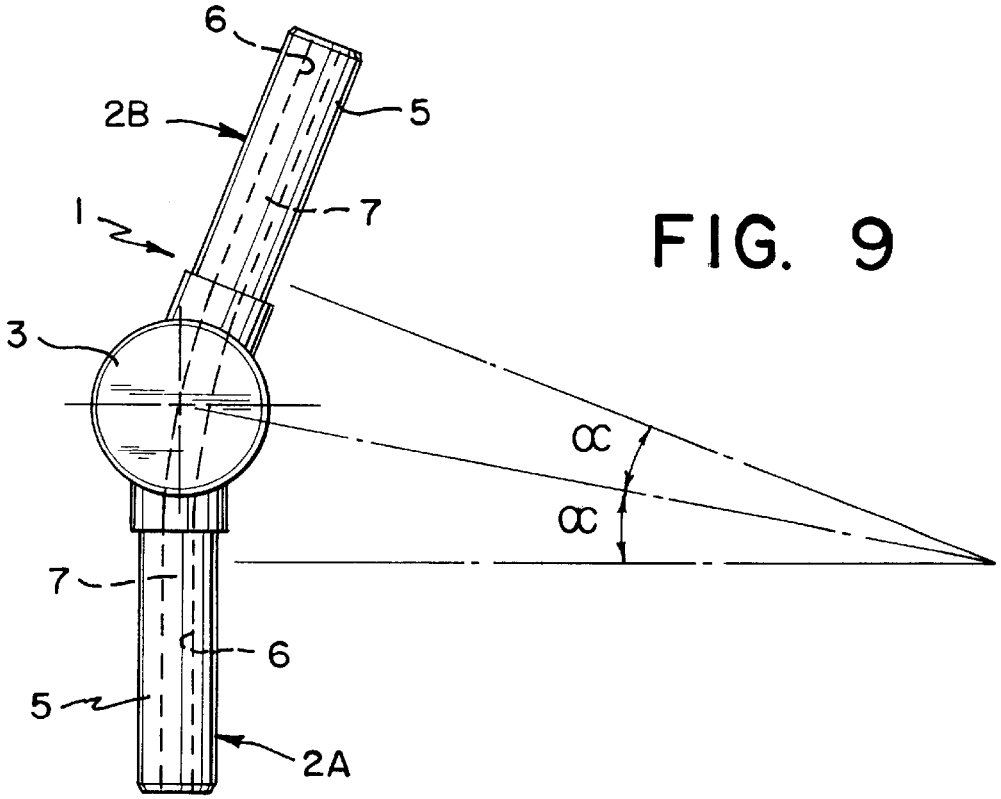
FIG. 9 is a front view similarly to FIG. 8, and illustrates an example of how the pivotable fastening members can pivot in relation to each other.

The cup-shaped pivotable portion 3 is extended with a stem or mounting piece 5 wherethrough there is provided a bore 6 or channel encircling a string-shaped elastic element 7 extending through both fastening members, see specifically FIGS. 7–9.

In the embodiment as illustrated in FIGS. 1–6, said stoppers 4A, 4B are appropriately provided as part of circle sectors having a spacing 8 therebetween, whereby said spacing 8 defines an extension of the channel or said bore 6 through the stem for thereby giving access to the previously discussed string-shaped elastic element 7.

Figure 2:
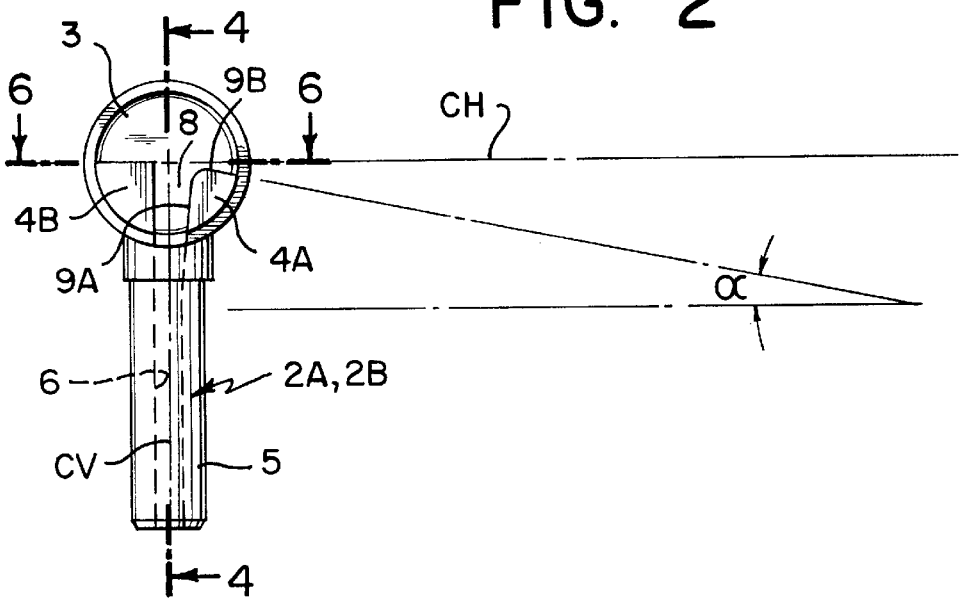
FIG. 2 is a view as seen from the other side of the embodiment of a pivotable fastening as illustrated in FIG. 1.

In FIG. 2 it is illustrated that the one stopper 4A is provided with inclined surfaces 9A and 9B, respectively, which inclined surfaces can for example take an angle of 11° in relation to, on the one hand, a vertical central line CV or, on the other hand, a horizontal central line CH. Otherwise, reference should be made to the angle $\alpha$ to the right in FIG. 2.

Since the stopper 4A of one of the pivotable members 2A is provided with inclined surfaces having a value of approximately 110, and since the second pivotable fastening member 2B is provided with corresponding stoppers, this will entail that in assembled position of said two pivotable fastening member 2A and 2B, see specifically FIG. 9, then said inclined surfaces will allow a pivotable deflection of approximately 22° before the respective stoppers abut against each other. The value 22° then refers to the base position of what is illustrated in FIG. 8, whereas FIG. 9 illustrates a position wherein the pivotable fastening members 2A and 2B have been pivoted to a maximum in relation to each other.

It is to be understood that said protruding stoppers 4A, 4B can be manufactured from any material, but preferably of the same material as the rest of said pivotable fastening members, for example plastic, metal, or any other appropriate material.

Possibly, said stoppers can be provided with a more or less resilient material than the rest of the fastening members, possibly with edge portions of a softer and more resilient material than the rest of the stoppers, for thereby to dampen and possibly extend said pivotable range beyond for example said 22°, all in dependence of the field of application and place of assembly of the chair in question.

It is to be understood that the stem or the mounting piece 5 of each pivoting member 2A and 2B, respectively, preferably is adapted to be mounted in the pipe-shaped chair member, and thereby being provided with for example a circular cross-section, as this appears from FIGS. 5 and 6. Said mounting piece 5 is thereby terminated with an upper collar 10 which can come to rest at the upper circumferential edge of a mounting pipe of a chair.

Figure 10:
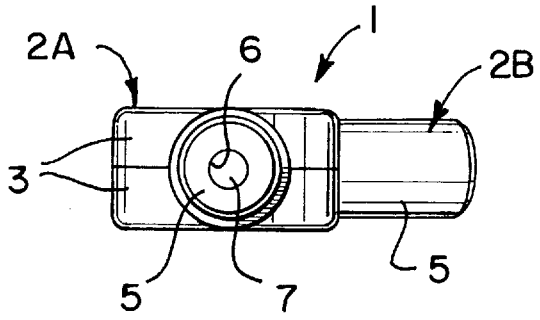
FIGS. 10, 11 and 12 illustrate various top views of the assembled embodiment of a pivotable fastening according to FIGS. 7–9, disclosing various examples of cross-sectional shapes, especially for the elastic element and corresponding channels through said pivotable fastening members.

In FIGS. 5 and 6 it is illustrated that said mounting piece 5 is provided with a hollow bore 6 having a round cross-section, and in such a case also the string-shaped elastic element 7 will have a corresponding round cross-section, see also FIG. 10.

Figure 11:
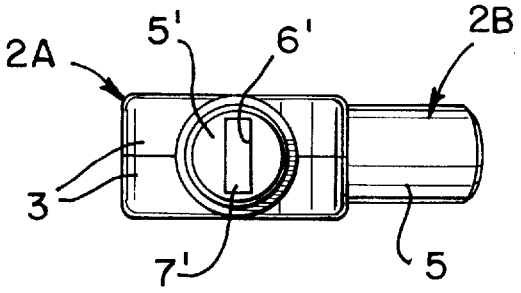

In FIG. 11 there is illustrated a variant of the cross-section of the elastic element 7', here provided with a rectangular cross-section, which corresponds to the matching regular cross-section of said bore or channel 6' in the mounting piece 5'.

Figure 12:
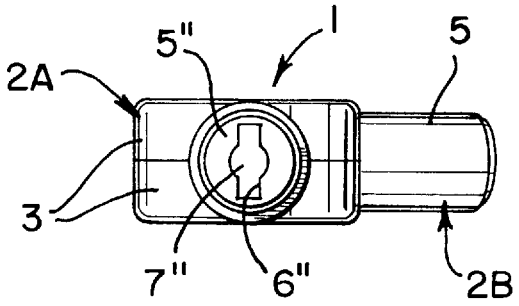

In FIG. 12 there is illustrated a further cross-section of said bore 6" in the mounting piece 5", which involves that in such a bore or channel 6" there may be used elastic element 7" having both round cross-section, rectangular cross-section, or a combination thereof.

It is to be understood that the string-shaped elastic element 7, 7', 7" can be designed with various cross-sections and of various materials, for example materials comprising steel, epoxy, glass fibre threads, etc., or a mixture thereof, possibly other appropriate elastic resilient materials.

The choice of material in said elongated string-shaped elastic element can appropriately be adapted to the material of said stoppers 4A, 4B, such that by an appropriate combination of materials there may be achieved various degrees of dampened deflection between said mutually pivotable fastening members 2A, 2B when the latter are mounted together as this is illustrated in FIGS. 7–9.

An appropriate use of an arrangement as disclosed so far and which is defined in the appending claims, can be in connection with chairs having a frame structure, two pivotable fastenings then being mounted in the back of the chair, and possibly two pivotable fastenings being mounted in the seat of said chair. The number and the positioning of such fastenings in a chair structure can, of course, be varied within wide limits.

What is claimed is:

1. A fastening between two elongated structural members, especially for use in a chair, for permitting relative pivotal movement of the structural members about a pivot axis perpendicular to the length of the two structural members, comprising:

first and second fastening members each having a generally cylindrical, cup-shaped pivotal portion formed about a central axis and first and second stoppers extending axially within and protruding from each said cup-shaped portion, a hollow connection portion extending generally radially from the cup-shaped portion adapted to be connected to one of the structural members, each said cup-shaped portion including a hollow space in communication with the hollow interior of the connecting portion;

said fastening members being rotatably joined with the respective central axes in alignment, to define said pivot axis, said connecting portions directed generally outwardly away from each other, and the stoppers of one of said cup-shaped portions extending towards the other cup-shaped portion; and a string-shaped elastic element extending from the connecting portion of the first fastening member, through the joined cup-shaped portions of the fastening members and into the connecting portion of the second fastening member.

2. A fastening as claimed in claim 1, wherein said stoppers are provided substantially as parts of cylindrical sectors and having a space therebetween, and said string-shaped elastic element passing through said space.

3. A fastening as claimed in claim 2, wherein each of said stoppers is provided with inclining surfaces allowing a pivotable range related to a non-influenced base position.

4. A fastening as claimed in 1, wherein said stoppers are made of a resilient material.

5. A fastening as in claim 4, wherein edge portions of said stoppers are made of a softer and more resilient material than the rest of said stoppers, for thereby dampening and possibly extending the pivot range.

6. A fastening as claimed in claim 1, wherein said respective connecting portions are opposite protruding mounting pieces, which are adapted to be mounted in pipe-shaped chair parts.

7. A fastening as claimed in claim 6, wherein said mounting pieces are provided with a round edged cross-section, said mounting pieces having a channel extending there along though which said string-shaped elastic element passes.

8. A fastening as claimed in claim 1, wherein said string-shaped elastic element has a cross-sectional shape from a group consisting of round, square, polygonal, and combination thereof, and said elements are made at least one member from the group consisting of steel, epoxy, glass fiber threads, and a mixture thereof, and other elastic/resilient materials.

9. In combination with a fastening as claimed in claim 1, a chair having a frame structure including two frame members, the fastening being mounted to the two frame members.

10. A fastening as claimed in claim 1, wherein each of said stoppers is provided with inclining surfaces allowing a pivotable range related to a non-influenced base position.

* * * * *